United States Patent [19]

Allen et al.

[11] 4,248,467

[45] Feb. 3, 1981

[54] LIFTING AND LOWERING DEVICE FOR HANDLING GOODS CONTAINERS

[75] Inventors: David Allen, Kettering; Robert J. Rowley, Peterborough, both of England

[73] Assignee: Modular Distribution Systems Limited, Peterborough, England

[21] Appl. No.: 28,373

[22] Filed: Apr. 9, 1979

Related U.S. Application Data

[63] Continuation of Ser. No. 798,861, May 20, 1977, Pat. No. 4,148,511.

[30] Foreign Application Priority Data

May 21, 1976 [GB] United Kingdom ..... 21146/76
Jan. 26, 1977 [GB] United Kingdom ..... 3152/77

[51] Int. Cl.[3] ..... B66F 7/16
[52] U.S. Cl. ..... 294/67 R; 414/608

[58] Field of Search ..... 294/67 R, 67 B, 67 BC, 294/67 BA, 67 D, 67 DA, 67 DB, 67 DC, 81 SF; 414/608, 29, 112, 117, 544

[56] References Cited

U.S. PATENT DOCUMENTS

| | | | |
|---|---|---|---|
| 3,447,697 | 6/1969 | Morey et al. | 414/608 |
| 3,586,183 | 6/1971 | Shaffer | 414/608 |

*Primary Examiner*—James B. Marbert
*Attorney, Agent, or Firm*—Larson, Taylor and Hinds

[57] ABSTRACT

A lifting and lowering device for attachment to the corner of an ISO goods container, comprising twist-lock devices carried at one side of a post and a sleeve which is slidable on and lockable to the post allowing adjustment of the spacing of the twist-lock devices, an extendable leg with its operating ram housed within the post, and projecting from the opposite side of the post from the twist-lock devices fixed legs or the like give to the device free-standing stability when the leg is fully retracted into the post.

4 Claims, 10 Drawing Figures

LIFTING AND LOWERING DEVICE FOR HANDLING GOODS CONTAINERS

Figure 2:
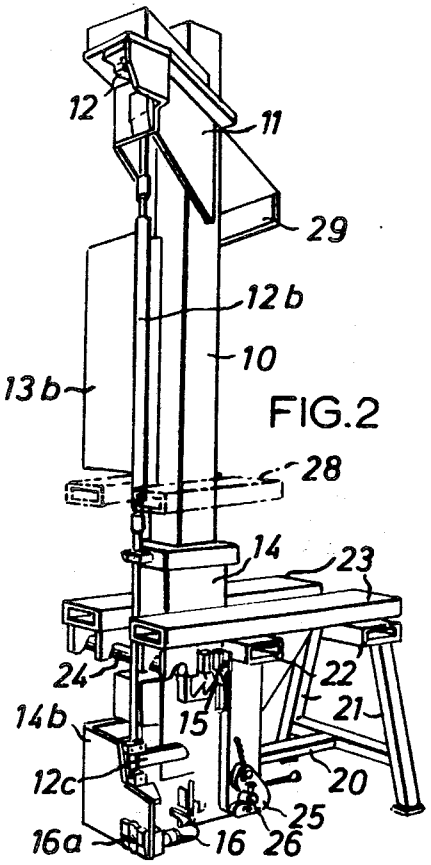

This is a continuation, of application Ser. No. 798,861 filed May 20, 1977 now U.S. Pat. No. 4,148,511.

DESCRIPTION

This invention relates to lifting and lowering devices for use in handling goods containers having ISO castings, particularly at their corners, which containers are commonly referred to as ISO containers. The ISO castings are provided to be engaged by twistlock devices by which the containers can be secured firmly in position on vehicles by which the containers are to be transported or by gantries or other heavy equipment as provided at large container depots for transferring the containers either between vehicles or from point to point in the depot.

Many forms of such heavy equipment have been proposed which are suitable only for use in large container depots and are incapable of use in confined spaces, and which are so expensive as to be uneconomic for operators handling only small numbers of containers.

This invention provides a form of lifting and lowering device which not only can be used in quite confined spaces, but also which is itself easily handled, when attaching it to or detaching it from a container, for example by using commonly available equipment such as a fork-lift truck.

According to the present invention, a lifting and lowering device for use with ISO containers comprises a post of non-circular section, an extendable leg of corresponding section housed within the post, hydraulic ram means within the post for effecting extension and retraction of the leg, a power pack supplying pressure liquid to the ram means, the power pack being mounted on the post, a sleeve slidable on the outside of the post, retractable locking means to lock the sleeve to the post in a number of positions along the post, first and second twist-lock devices on the post and on the sleeve respectively whereby adjustment of the position of the sleeve on the post adjusts the spacing of the first and second twist-lock devices, the twist-lock devices being offset to one side of the post and ground-engaging support means projecting from the post on its side remote from the twist-lock devices whereby with the leg fully retracted the post is capable of stable free-standing.

Such a device is not only utilisable in a confined space and itself easily handled but also is readily adjustable for variations in the height of ISO containers and when not in use can, due to its freestanding stability, be stored in any convenient plane without the use of special facilities such as racks.

The following is a description by way of example of a number of embodiment of lifting and lowering device of this invention, the embodiments being illustrated on the accompanying drawings.

Figure 1:
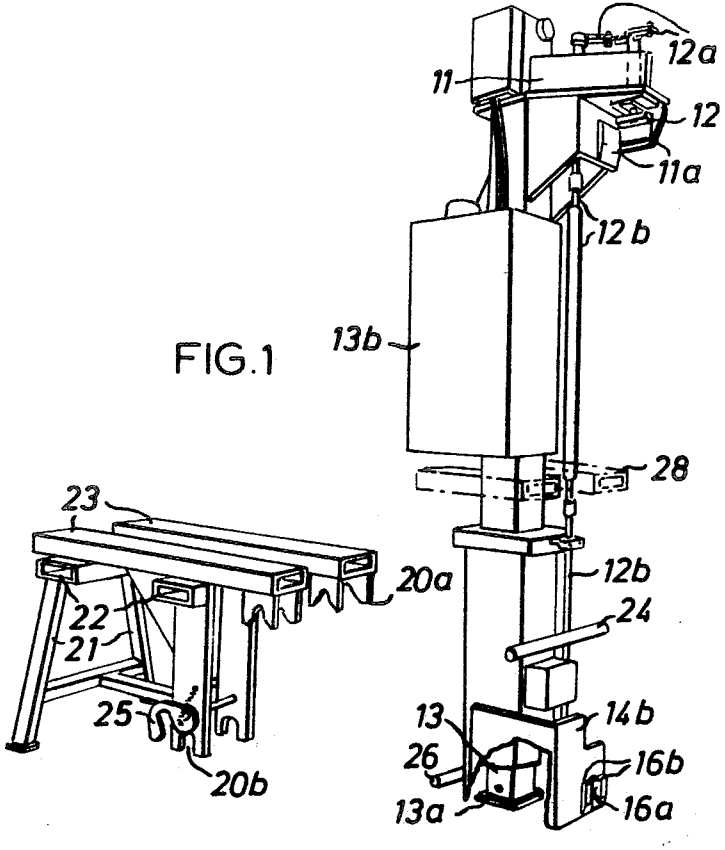
Figure 3:
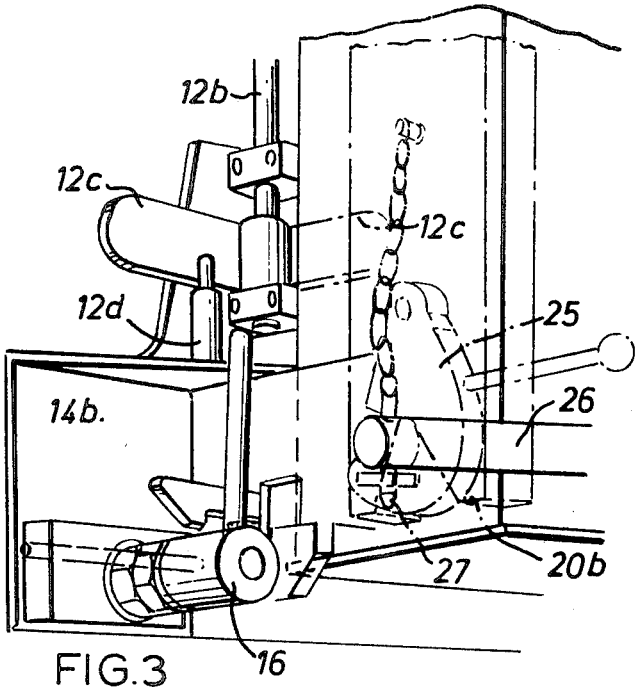
Figure 4:
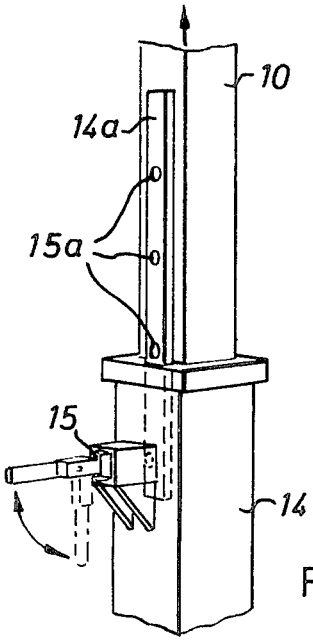
Figure 10:
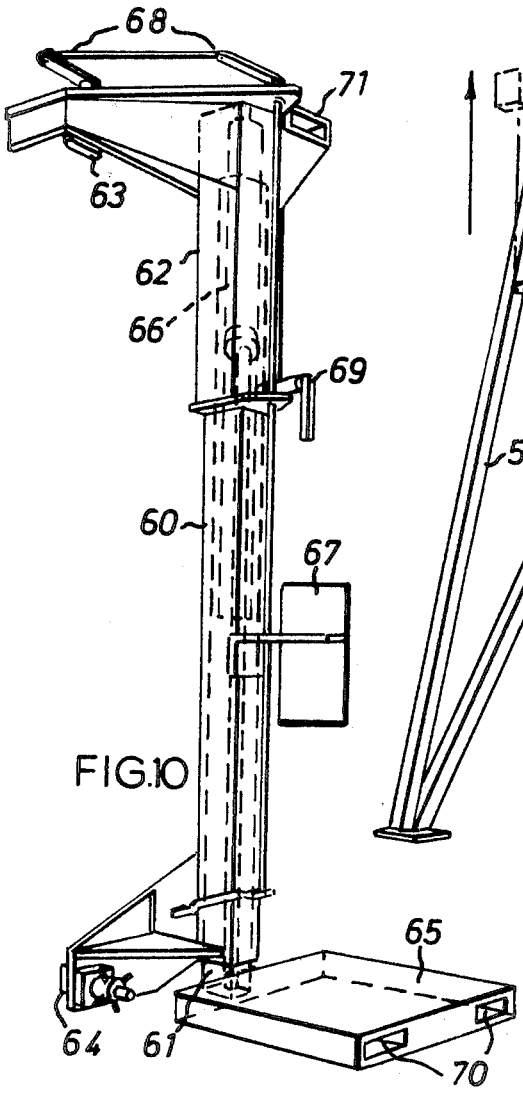
Figure 5:
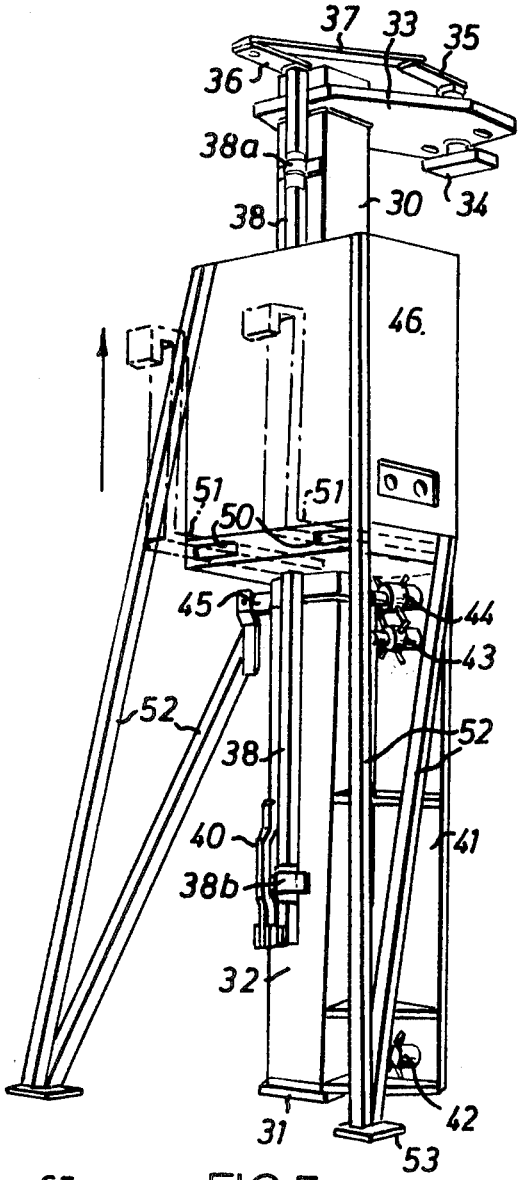

In the drawings:

FIGS. 1 and 2 are perspective views of one construction of device of this invention, part of FIG. 1 being broken away to show a detail of construction, FIG. 3 is a view to a larger scale of a part of the device of FIGS. 1 and 2, FIG. 4 is a view illustrating a detail of construction, FIG. 5 shows a second construction, FIGS. 6 to 9 show details of the device of FIG. 5, and FIG. 10 shows a third construction.

Referring to FIGS. 1 to 4, the device shown comprises a post 10 of a rectangular, e.g. square, cross-section provided at its upper end with a projecting bracket structure 11 carrying a top twist-lock device 12.

The post 10 houses an extendable leg 13, likewise of rectangular cross-section, and also a hydraulic ram (not shown) for extending and retracting the leg 13 which has at its lower end a foot 13*a*. A power pack 13*b* comprising an electric motor driving a pump is mounted on the post 10 to supply pressure liquid to the ram.

The post 10 has slidably mounted on it a sleeve 14, also of rectangular section, carrying a retractable plunger 15 which can be engaged with one of a series of holes 15*a* in a guide strip 14*a* (FIG. 4) secured to the post thereby to hold the sleeve in a selected position lengthwise of the post 10.

At its lower end the sleeve 14 has a projecting bracket 14*b* carrying a bottom twist-lock device 16 the head 16*a* of which, when retracted as in FIG. 1, lies between protective cheeks 16*b*.

The top twist-lock device 12 is operated from ground level by means of a linkage 12*a* actuated by a rotatable telescopic shaft 12*b* and actuating handle 12*c*. To rotate the twist-lock device 12*c*, the handle 12*c* (FIG. 3) with the lower part of the shaft 12*b* is raised to clear a fixed peg 12*d*, is rotated through 90° and then lowered so as to be retained in its second position. The lower part of the shaft 12*b* is mounted in spaced bearings 17 between which the handle 12*c* lies so that the upward travel of the handle is restricted.

In order to render the device capable of free stable standing, it is provided on the side remote from the twist-lock devices with a framework 20 with fixed legs 21 and sockets 22, 23 set at 90° to each for engagement by the prongs of a fork lift machine. The framework may be rigid with the sleeve 14 or, as is preferred and shown may be detachable from the sleeve. For this purpose, the frame has notched lugs 20*a*, 20*b* to engage over an upper bar 24 and lower bar 26, both rigid with the sleeve 14, and lockable latches 25 to engage below a second bar 26. A pin 27 passes through one end of the bar 26 and a lug 25*a* on one of the latches 25 to hold the latches in the engaged position.

In use the operating height of the lifting and lowering device is adjusted whilst standing on the ground by releasing the plunger 15 and then raising the post 10 by means of a fork lift machine engaging pockets 28 or lifting eye 29 on the post. When the twist-lock devices 12 and 16 have the correct separation the plunger is engaged with one of the holes 15*a*.

After ensuring that the twist-lock devices 12, 16 are in their inoperative positions, the device may now be fitted to a container (a) by lifting the whole device using a fork lift machine, its prongs engaging the pockets 22 or 23, (b) by then engaging the twist-lock device 12 with the upper corner ISO casting which operation is assisted by the guiding action of gussets 11*a* contacting the vertical faces of a corner casting of the container prior to downward entry of the head of the twist-lock device 12 into the casting, (c) by then entering the twist-lock device 16 into a bottom ISO casting of the container, (d) locking both twist-lock devices 12, 16 in the top and bottom ISO casting respectively.

To lift a container four such devices may be attached to the corners of the container and the legs 13 extended until the container reaches the appropriate height to allow say a vehicle to be driven below the container whereupon the container may be lowered on to the vehicle by retracting the legs.

Accordng the requirements, the frameworks 20 may be left in place or removed, or the devices may then be detached from the container using a fork lift machine.

Referring now to FIGS. 5 to 9, the device illustrated (see FIG. 5) comprises a single hollow post 30 of non-circular cross-section, e.g. square cross-section, an extendable and retractable leg of similar section slidable within the post 30 terminating in a foot 31 for ground engagement, and a sleeve 32 also amenably sized and slidable on the outside of the post 30.

The leg is extended and retracted by an hydraulic ram (not shown) accommodated in the post 30.

Figure 8:
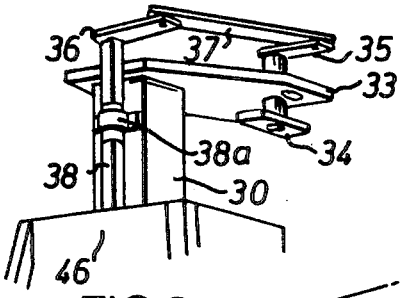
Figure 6:
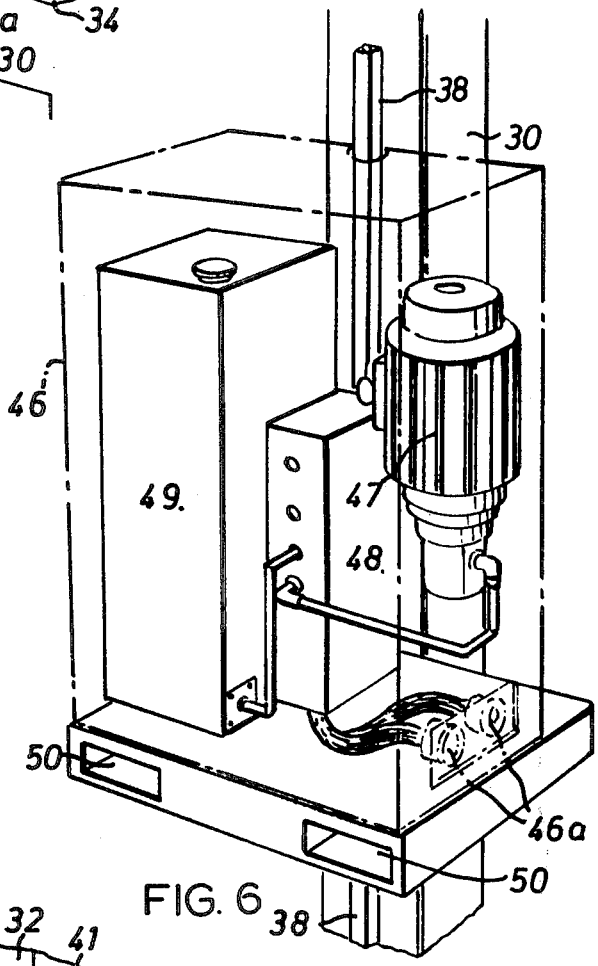
Figure 9:
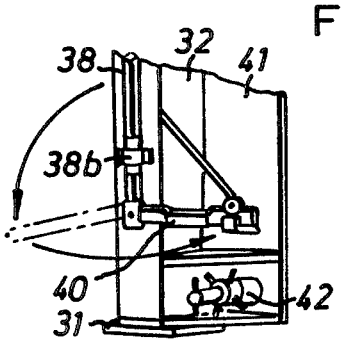
Figure 7:
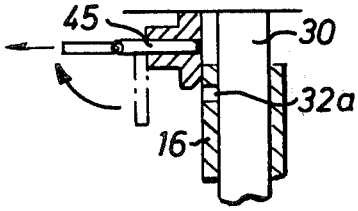

The post 30 has at its upper end an overhung flange 33 carrying a downwardly-projecting twist-lock device 34 for engagement with a top ISO casting or the like of a container. The twist-lock device 34 is turned from its locked setting (FIG. 5) to its unlocked setting (FIG. 8) by a remote control. The remote control is shown as a linkage comprising a radius arm 35 on the twist-lock device joined to an arm 36 by a link 37, the arm 36 being on the upper end of telescoping square-sectioned shafts 38 with parts to engage bearings 38*a*, 38*b* on the post 30 and sleeve 32 respectively. At its lower end the shafting carries a pivoted handle 40 which can be locked in the position of FIG. 5 or swung down and then laterally through 90° and locked in the position of FIG. 9 which corresponds to the position of the twist-lock device 14 as shown in FIG. 8. This enables the twist-lock device 34 to be adjusted from ground level.

The sleeve 32 has a lateral flange 41 carrying a bottom twist-lock device 42 and mid-height twist-lock devices 43, 44. The position of the devices 42 to 44 can be adjusted relatively to the twist-lock device 34 by retracting a locking pin 45, which is mounted on the post 30, from engagement with a hole 32*a* in the sleeve 32 (FIG. 7) so allowing the sleeve to rest on the foot 31. Thus when the leg is extended and retracted the sleeve follows the movement so that, when the twist-lock device 34 is engaged with a top ISO casting, the lower devices can be moved vertically until aligned with a bottom ISO casting.

The handling device has its own power pack 46 (FIG. 5) which is mounted rigidly on the post 30. The pack 46 comprises (FIG. 9) and electrically-driven pump unit 47, electrically-controlled valve gear 48 and a fluid reservoir 49 forming part of an hydraulic circuit for operating the hydraulic ram for moving the leg. Electrical sockets 46*a* are provided for electrical power supply and cable connections to a control console.

Also on the post 30 there are a pair of fork-lift sockets 50, conveniently just below the power pack 46, so that the device can be manoeuvred by a small fork-lift truck, the prongs 51 (FIG. 5) engaging the sockets 50.

The handling device also comprises an outrigged structure which projects from the side of the post remote from the twist-lock devices and includes non-extendable splayed legs 52 which are secured to the post 30 and which, when the extendable leg is fully retracted, allow the device to be free-standing on the ground with its centre of gravity more or less centrally above the three ground contact points provided by the foot 31 and feet 53 on the legs 52.

FIG. 10 shows another form of lifting and lowering device and it comprises a post 60, an extendable leg 61 housed in the post, a sleeve 62 slidable on the upper end of the post and carrying a top twist-lock device 63, a lower twist-lock device 64 on the lower end of the post, and a platform foot 65 secured on the lower end of the leg. The leg is operated by an hydraulic ram 66 housed in the post and supplied with pressure liquid from power pack 67.

The platform foot 65 projects from the side of the post remote from the twist-lock devices 63, 64 and can if desired be loaded as by concrete blocks to render the device very stable when standing free on the ground.

A linkage and telescoping shaft 68 as previously described is provided to operate the top twist-lock device.

A retractable plunger 69 is provided to hold the sleeve in adjusted position on the post.

It will be appreciated that many variations are possible. For instance handling devices are illustrated in FIGS. 1 to 4 and 10 may have half-height twist-lock devices such as those shown at 43, 44 in FIG. 5. Also mid-height fork-lift sockets may be provided on the handling device of FIG. 10 in addition to sockets 70 in the platform and socket 71 on the sleeve.

We claim:

1. A lifting and lowering device for attachment to a goods container having ISO castings or the like fitments, the device comprising a hollow post, a leg slidably housed within the post and having a foot for contacting the ground when lifting or lowering the container, power-operated means connected to effect sliding of the leg relative to the post, upper and lower twist locks carried by the device on one side thereof for lockably engaging the ISO castings or the like of a container to which the lifting and lowering device is to be attached, one of said twist locks being adjustable in position length-wise of the post, said upper twist lock being rotatable between a locked position and an unlocked position, operating means mounted on the post spaced below the upper twist lock and connected to it to effect rotation of the upper twist lock between said locked and unlocked positions, means engagable by a mechanical machine to enable the device to be positioned on a container, and ground-engaging means mounted on the device and adapted when the leg is retracted to contact the ground at positions off-set from the foot to render the device stable when free-standing.

2. A lifting and lowering device according to claim 1, wherein said ground-engaging means comprises splayed non-extendable legs secured to the post, which legs, when the sliding leg is retracted, contact the ground so that the center of gravity of the device is central above the three points at which the foot and the non-extendable legs contact the ground.

3. A lifting and lowering device according to claim 1, wherein said ground-engaging means comprises auxiliary legs mounted on a framework lockable to and detachable from the post.

4. A lifting and lowering device according to claim 1, wherein the ground-engaging means comprises a platform extending from the foot on the side of the post remote from said locking devices.

* * * * *